United States Patent [19]

Okumura

[11] 4,077,378

[45] Mar. 7, 1978

[54] DISTRIBUTOR WITH NOISE SUPPRESSING DEVICE

[75] Inventor: Nozomu Okumura, Nagoya, Japan

[73] Assignee: Nippondenso Co., Ltd., Kariya, Japan

[21] Appl. No.: 642,447

[22] Filed: Dec. 19, 1975

[30] Foreign Application Priority Data

Mar. 28, 1975 Japan ..... 50-37495

[51] Int. Cl.[2] ..... F02P 1/10

[52] U.S. Cl. ..... 123/148 P; 200/19 DC; 200/19 DR; 200/262

[58] Field of Search ..... 123/148 P; 200/19 DC, 200/19 DR, 262, 263, 264, 265, 266, 267

[56] References Cited

U.S. PATENT DOCUMENTS

| | | | |
|---|---|---|---|
| 1,984,276 | 12/1934 | Mallory | 123/148 P |
| 2,291,652 | 8/1942 | Rose | 123/148 P |
| 2,555,488 | 6/1951 | Hetzler et al. | 123/148 P |

FOREIGN PATENT DOCUMENTS

| | | | |
|---|---|---|---|
| 408,453 | 12/1944 | Italy | 123/148 P |

*Primary Examiner*—Wendell E. Burns

*Attorney, Agent, or Firm*—Cushman, Darby & Cushman

[57] ABSTRACT

In a distributor having a pair of electrodes, which comprises a rotor electrode and a side electrode, at least one electro-conductive metal member is disposed between the pair of electrodes to extend from one to the other, whereby generation of radio noise is suppressed.

10 Claims, 3 Drawing Figures

DISTRIBUTOR WITH NOISE SUPPRESSING DEVICE

BACKGROUND OF THE INVENTION

Radio noises generated by automobiles have brought about a serious problem to communication equipments such as radios and TV. To cope with such a problem, some countries have established and enforced regulations for reducing such noises. It has been known that the ignition distributor for automobiles is one of the main points where such a noise is generated. When the spark occurs between the rotor electrode and each of the side electrodes, a jamming radio wave comes out. However no effective noise suppressing device for the distributor has been developed yet.

SUMMARY OF THE INVENTION

It is an object of the present invention to provide a distributor having noise suppressing device which can effectively suppress the generation of radio wave causing radio noise or jamming on the communication equipments such as radios and TV.

The other object of the present invention is to develop a durable noise suppressing device for a distributor.

Further object of the present invention is to provide a thin metal member between the rotor electrode and each of the side electrodes for facilitating the generation of initial spark, thereby suppressing the generation of high frequency radio wave between the two electrodes.

The other objects, features and advantages of the present invention will be apparent from the following detailed description of the preferred embodiment.

DETAILED DESCRIPTION OF PREFERRED EMBODIMENT

Figure 1:
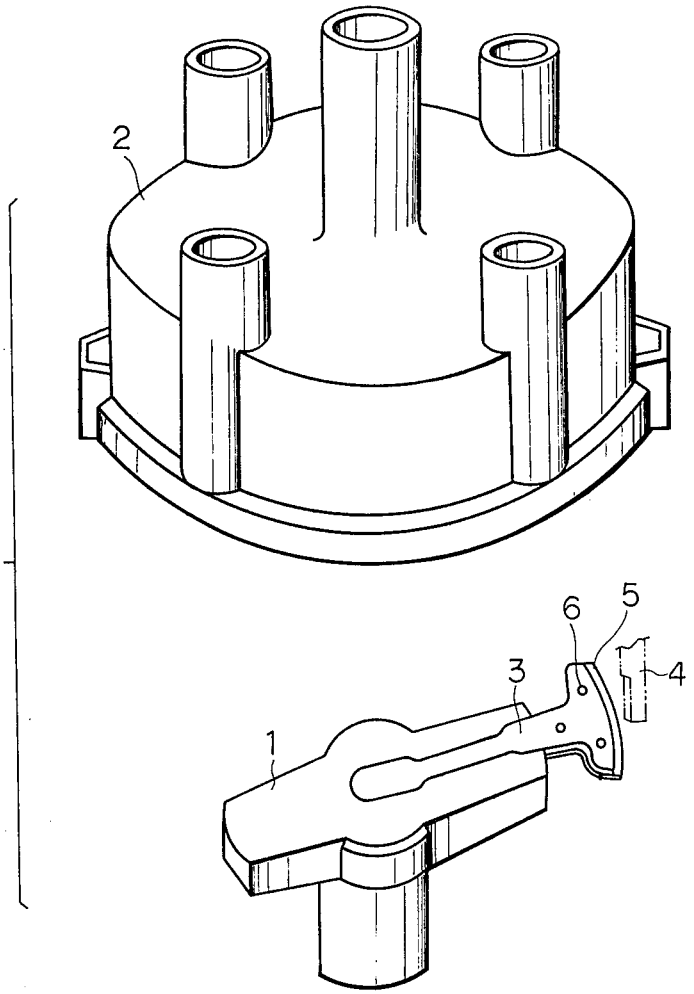
FIG. 1 shows a schematic view of a cap and a rotor of the distributor with noise suppressing device according to the present invention.

Referring to FIG. 1, a rotor 1 is fixed to an upper portion of the distributor shaft (not shown) to rotate in response to the rotation of the crank shaft (not shown). A cap 2 is fixed to a housing (not shown) of the distributor to cover the rotor 1. The rotor 1 and the cap 2 respectively have a rotor electrode 3 made of brass and a plurality of side electrodes 4 usually made of aluminum. As in the conventional distributor, the rotor electrode 3 generally faces to the side electrodes 4 with a clearance of about 0.5 to 1.5 mm. The rotor electrode 3 has a thin metal member 5 made of stainless steel, which is secured thereto by a spot welding 6. The metal member 5 has a width extending in the rotational direction of the rotor electrode 3 for covering all the spark timings as in the conventional rotor electrode. The thickness of the metal member 5 is determined within a range from 0.04 to 1.50 mm. The stainless steel member 5 can be replaced by a steel, alminum, brass or copper piece, and fixed by soldering, rivets in stead of the spot welding as well.

Since the above rotor electrode 3 having metal member 5 is installed, when high voltages are distributed, an initial spark runs, at first, from the edge of the metal member 5 to one of the side electrodes 4, then a main spark follows, running from the rotor electrode 3 to the side electrodes 4. The initial spark from the metal member 5 prevents the generation of high frequency radio wave, resulting in less radio noise in various radio wave equipments.

A test result on the reduction of radio noise taken with a metal member made of stainless steel having a thickness of 0.1 mm is as follows.

| | Evaluation | |
|---|---|---|
| Conventional rotor electrode | 30 | (dB) |
| New rotor electrode with a thin metal member | 18 | (dB) |

In this test, the evaluation value was taken at a frequency of 65 MHZ of the vertical wave, and clearance between the metal member 5 and the side electrodes 4 was 0.75 mm.

The result shows that the rotor electrode 3 with the metal member 5 of the present invention reduces the noise level much more than the conventional one having no metal member. In the test, the noise level reducing effect was significantly effective, when the thickness of the metal member 5 was in the range from 0.04 to 1.50 mm.

The solution of the above noise level reducing effect based on the installation of the metal member has not been made clear yet besides the following. As the metal member 5 is thin, the spark is initiated from the outer edge of the metal member 5, as the spark occurs between needle electrodes much more readily than between spherical electrodes. This initial spark increases the number of ions in the air gap between the rotor electrode 3 and the side electrodes 4. Thereafter, the main spark occurs between the outer edge of the rotor electrode 3 and the side electrodes 4 through the air gap having thick ions produced by the preceding initial spark. As a result, this initial sparking contributes to a reduction in the generation of high frequency radio waves, i.e., the reduction of noise level. Further the increase of resistivity, which is caused by the temperature rise, at the top edge of the piece 5 also seems to contribute to the degradation of noise level, since the rush current is prevented from flowing therethrough.

Figure 2:
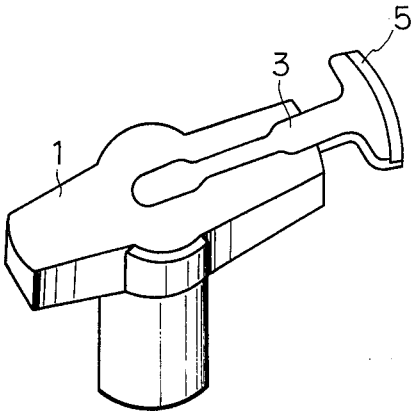
FIG. 2 shows a schematic view of the second embodiment of the noise suppressing device according to the present invention.

Referring to FIG. 2, the metal member 5 is formed by cutting off the upper and outer edge of the rotor electrode 3, the thickness thereof being between 0.04 mm and 1.50 mm. Therefore, no separate member as in the first embodiment is required.

Figure 3:
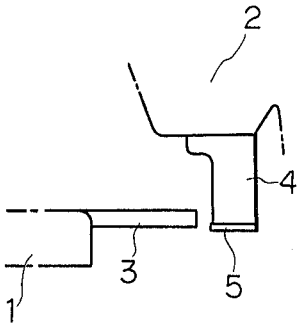
FIG. 3 shows a schematic view of the third embodiment of the noise suppressing device according to the present invention.

Referring to FIG. 3, the metal member 5 is secured to the lower end of the side electrodes 4 instead of being secured to the rotor electrode 3 as in the first embodiment. To this embodiment, the metal member of the same material and same thickness as in the first embodiment shown in FIG. 1 is available likewise.

In all the embodiments, it is more effective to make the outer edge of the metal member 5 rugged, since the initial spark occurs much more readily than the smooth one.

What I claim is:

1. A distributor with noise suppressing device having a pair of electrodes which comprises a rotor electrode fixed on a rotor and a side electrode built in a cap of the distributor, wherein said pair of electrodes have a thin metal member which extends from one electrode to the other and in the rotational direction of said rotor electrode for suppressing the generation of radio noise.

2. A distributor as claimed in claim 1, wherein said thin metal member is made of a separate member fixed to said rotor electrode.

3. A distributor with noise suppressing device comprising:

a rotor;

a rotor electrode fixed on said rotor for rotation therewith;

a distributor cap covering said rotor and rotor electrode;

a plurality of side electrodes fixed at separate locations to said cap about the interior of said cap adjacent the path of rotation of said rotor electrode, said rotor electrode including a conductive plate member having an outer edge extending into proximity with each of said side electrodes in turn as said rotor electrode is rotated;

a thin metal plate member having a thickness substantially less than the thickness of said outer edge of said conductive plate member and fixed to one of said electrodes so that the initial spark between said rotor electrode and each of said side electrodes in turn occurs through said thin plate member, and the main spark occurs between said conductive plate member and each of said side electrodes in turn to suppress radio noise generated by said sparks.

4. A distributor as in claim 3, wherein said thin plate member extends parallel to said conductive plate member.

5. A distributor as claimed in claim 4, wherein said thin metal member is formed by cutting off the upper and outer edge of said conductive plate member of said rotor electrode.

6. A distributor with noise suppressing device as claimed in claim 4, wherein the thickness of said metal member is between 0.04 mm and 1.50 mm.

7. A distributor as in claim 4, wherein said thin plate member is fixed to said conductive plate member.

8. A distributor as in claim 4, wherein said thin plate member is fixed to each of said side electrodes.

9. A distributor as in claim 8 wherein each of said thin metal members is fixed at the respective lower end of said side electrode, thereby suppressing the generation of radio noise.

10. A distributor as claimed in claim 9, wherein said thin metal member is made of a separate member fixed to said rotor electrode.

* * * * *